US009687685B1

(12) United States Patent
Chmielewski

(10) Patent No.: US 9,687,685 B1
(45) Date of Patent: Jun. 27, 2017

(54) DEVICE FOR GENERATING COMPRESSED AIR FOAM FOR USE IN FIRE SUPPRESSION

(71) Applicant: Michael Paul Chmielewski, Colchester, VT (US)

(72) Inventor: Michael Paul Chmielewski, Colchester, VT (US)

( * ) Notice: Subject to any disclaimer, the term of this patent is extended or adjusted under 35 U.S.C. 154(b) by 51 days.

(21) Appl. No.: 14/520,560

(22) Filed: Oct. 22, 2014

Related U.S. Application Data

(60) Provisional application No. 61/895,564, filed on Oct. 25, 2013.

(51) Int. Cl.
*A62C 5/02* (2006.01)
*A62C 31/12* (2006.01)

(52) U.S. Cl.
CPC ..... *A62C 5/022* (2013.01); *A62C 31/12* (2013.01)

(58) Field of Classification Search
CPC ..... A62C 5/022; A62C 31/12
USPC ..... 239/418, 416.1–416.5, 422, 399, 423, 239/463, 428.5; 169/30
See application file for complete search history.

(56) References Cited

U.S. PATENT DOCUMENTS 3,424,250 A * 1/1969 Thomae ..... A62C 3/0207 169/15
3,607,779 A * 9/1971 King ..... A62C 3/0207 169/15
4,427,074 A * 1/1984 Wollin ..... A62C 3/0207 169/46
4,474,680 A * 10/1984 Kroll ..... B01F 3/04446 169/15
4,732,181 A * 3/1988 Sollander ..... F41H 3/00 141/100
5,054,688 A 10/1991 Grindley
5,113,945 A 5/1992 Cable
5,125,797 A * 6/1992 Kapich ..... A62C 3/0207 415/202
5,253,716 A 10/1993 Mitchell
5,382,389 A 1/1995 Goodine et al.
5,445,226 A 8/1995 Scott et al.
5,590,719 A * 1/1997 McLoughlin ..... A62C 31/03 169/13
5,848,752 A 12/1998 Kolacz et al.
(Continued)

OTHER PUBLICATIONS

Wikipedia. Printed Oct. 22, 2014. "Injectors". http://en.wikipedia.org/wiki/Injector. 8 pages.

*Primary Examiner* — Arthur O Hall
*Assistant Examiner* — Adam J Rogers
(74) *Attorney, Agent, or Firm* — Thomas G. Ference

(57) ABSTRACT

A device for generating compressed air foam for use in fire suppression, the device may be attached to standard pressurized sources of water used for fighting fires. The device comprises a water chamber adjacent to an air chamber with a partition there between. A water impeller resides at least partially within the water chamber and an air impeller resides at least partially within the air chamber. The pressurized source of water drives the water impeller, which in turn is connected to drive the air impeller. The air impeller sucks air into the air chamber and compresses the air. The air then passes through a nozzle in the partition to aerate the source of water containing foam solutes to form compressed air foam. The compressed air foam exits the device with a velocity to coat a fire to be extinguished.

21 Claims, 8 Drawing Sheets

(56) References Cited

U.S. PATENT DOCUMENTS

| | | | | |
|---|---|---|---|---|
| 5,881,818 | A * | 3/1999 | Lee | A62C 37/50 169/15 |
| 5,934,568 | A | 8/1999 | Brown | |
| 6,102,308 | A | 8/2000 | Steingass et al. | |
| 6,113,004 | A * | 9/2000 | Steingass | A62C 5/02 169/30 |
| 6,173,908 | B1 | 1/2001 | Bureaux et al. | |
| 6,543,547 | B2 | 4/2003 | Neumeir et al. | |
| 7,021,391 | B2 | 4/2006 | Schasteen | |
| 7,776,213 | B2 * | 8/2010 | Arnaud | B01D 21/2433 137/888 |
| 8,056,831 | B2 | 11/2011 | Crampton | |
| 2007/0209807 | A1 * | 9/2007 | Kruger | A62C 5/02 169/15 |
| 2010/0038101 | A1 * | 2/2010 | Terry | A62C 31/07 169/70 |
| 2011/0042108 | A1 | 2/2011 | Hiebert | |
| 2012/0247790 | A1 | 10/2012 | Young et al. | |

* cited by examiner

DEVICE FOR GENERATING COMPRESSED AIR FOAM FOR USE IN FIRE SUPPRESSION

RELATED APPLICATIONS

This application claims the benefit of priority of U.S. Provisional Patent Application No. 61/895,564, filed Oct. 25, 2013, which is herein incorporated by reference.

FIELD

This present invention generally relates to a device that generates compressed air foam for suppressing fires. More specifically, the device includes a water impeller driven by a source of pressurized water containing foam solutes; the water impeller drives an air impeller to create compressed air that is then injected into the source of water to aerate the water and create the compressed air foam.

BACKGROUND

Fire suppression is generally based on removing one or more of the three ingredients needed for most fires to burn. These ingredients include fuel, oxygen and heat. Together these ingredients make up portions of what is commonly referred to as the fire suppression triangle. If one or more of these ingredients can be removed, combustion will be unable to be sustained.

It is commonly recognized that water is one of the best agents to extinguish fires. In sufficient quantities, water can extinguish the fire by interrupting the fire's chemical chain reaction. Water does this by either removing the necessary amount of heat required to sustain combustion or by displacing a sufficient amount of oxygen from the fire thereby interrupting the chemical chain reaction. In most municipal fire suppression settings, water is typically readily available at a cost reasonable for extinguishment. Even when water is available to put out a fire, water does have some drawbacks. These include moderate viscosity (internal resistance to flow and to penetrate burning substances), a high surface tension, minimal retention capability (will quickly be affected by gravity and drain off substances), and water can evaporate relatively quickly.

To minimize water's drawbacks various additives may be introduced into the water to improve the water's firefighting capabilities. Adding foam producing solutes and compressed air to water can be used to create compressed air foam, which is known to improve the firefighting properties of water. Compressed Air Foam Systems (CAFS) use a synthetic detergent derivative as a foaming agent. A CAFS typically uses a water pumping system in which a foam solution is added to the water and an additional air compressor system that injects air into the solution to generate the foam. The air compressor also provides energy, which propels compressed air foam farther than aspirated or standard water nozzles.

Scientifically, CAFS impedes all three sides of the fire triangle simultaneously. The foam blankets the fuel, thereby reducing the fuel's capacity to react with a source of oxygen. The CAFS solution adheres to surfaces, more readily aiding in rapid reduction in heat. Also, the foam creates an insulation barrier shielding the fuel source from radiant energy.

The implementation of a CAFS usually requires expensive equipment. The typical cost of a CAFS ranges between $25,000 and $40,000 per installation each time a new firefighting apparatus is purchased. These costs are driven by hardware, such as an added compressor. Additional costs are required when retrofitting existing firefighting apparatus. The average lifespan of a fire fighting apparatus in the United States is fifteen years with twenty years not being unusual. Jurisdictions will typically not spend the money and time to retrofit the existing fleet of firefighting apparatus, which requires both taking the apparatus out of service for a period of time and spending money to add a CAFS capability to an apparatus. Given a life span of 15 years, a fire fighting apparatus which is purchased in 2014 without CAFS would probably not be upgraded or replaced until 2029.

It would therefore be of benefit to have a simpler, less expensive CAFS that could be fitted directly onto current firefighting equipment. The current invention provides for such a simple, inexpensive attachment device that integrates with current pressurized water sources to create compressed air foam for improved firefighting.

SUMMARY

One aspect of the present invention is directed to a device for generating compressed air foam from a source of pressurized water containing a foam solute. The device comprises a water chamber having a water source inlet and a water source outlet. A water impeller is at least partially contained within the water chamber; the water impeller is driven by movement of the source of pressurized water. The device further comprises an air chamber adjacent to the water chamber with a partition there between. The air chamber has an air source inlet and an air source outlet. An air impeller is at least partially contained within the air chamber. The water impeller drives the air impeller to compress a source of air taken in from the air source inlet to form compressed air. The compressed air exits through the air source outlet to aerate the source of water and create compressed air foam.

BRIEF DESCRIPTION OF DRAWINGS

The foregoing and other aspects and advantages of the present invention will be apparent from the following detailed description, as illustrated in the accompanying drawings, in which.

DETAILED DESCRIPTION

Figure 1:
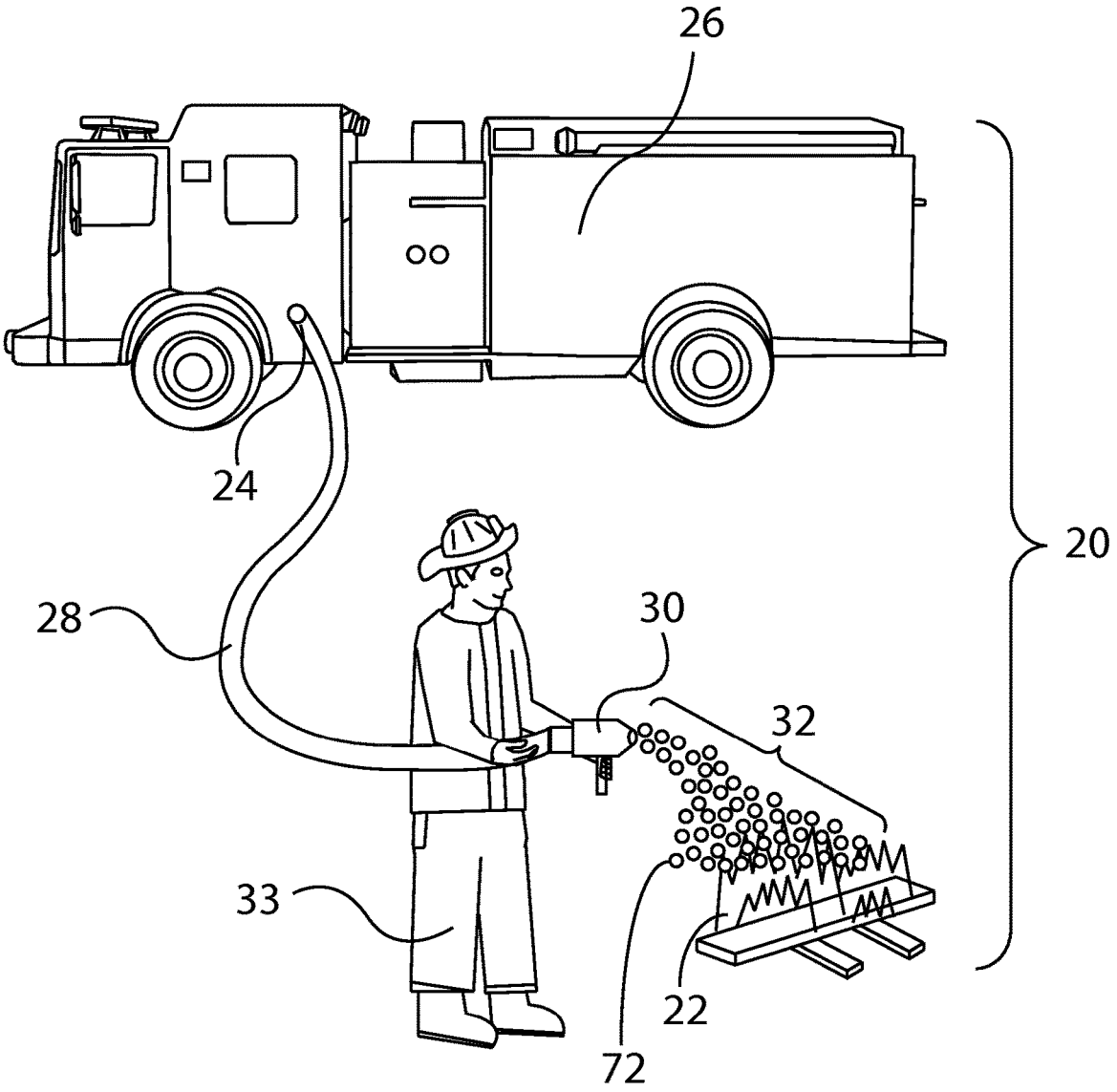
FIG. 1 is a schematic diagram showing an embodiment of a system for fighting fires, the system using a device for generating compressed air foam as described in the present disclosure.
Figure 2:
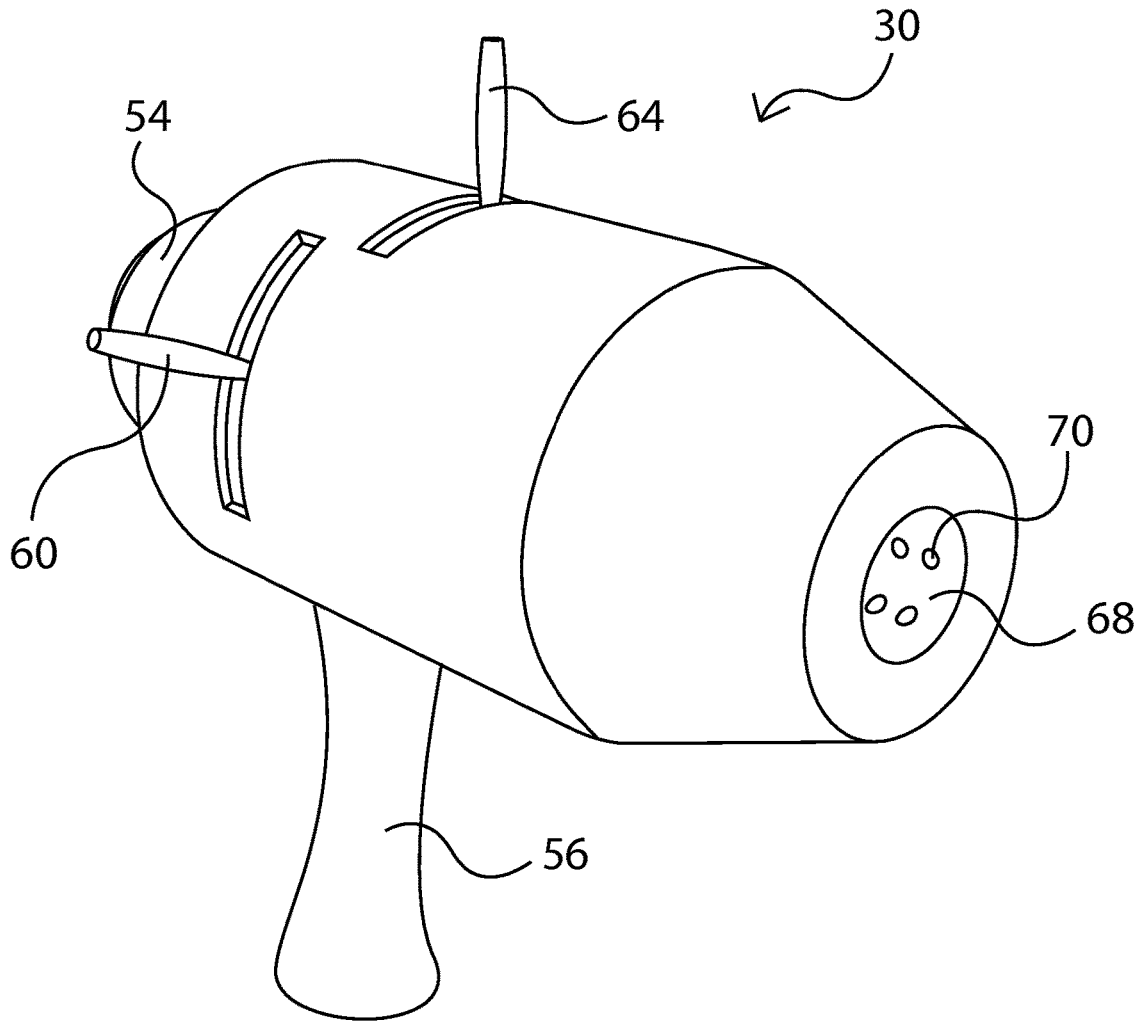
FIG. 2 is a front, perspective view of one embodiment of the device for generating compressed air foam of the system shown in FIG. 1.
Figure 3:
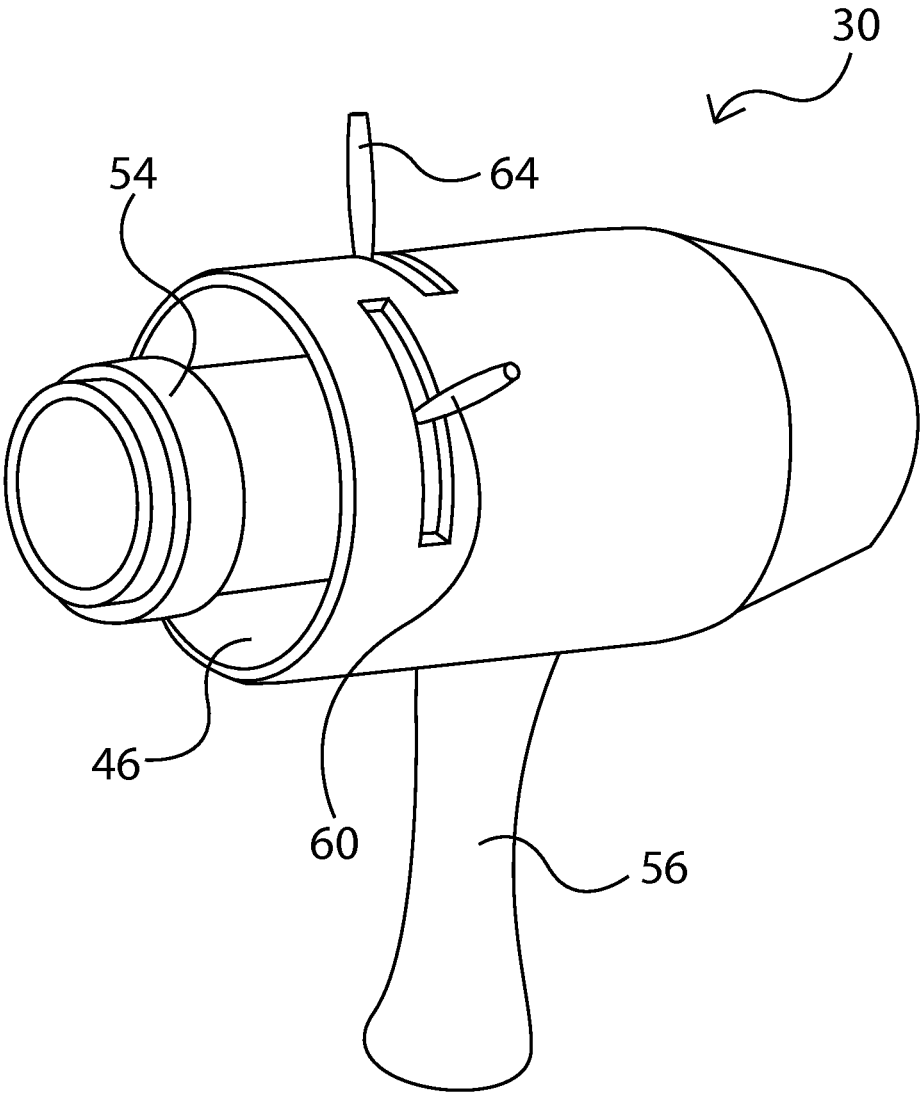
FIG. 3 is a back, perspective view of the device shown in FIG. 2.
Figure 4:
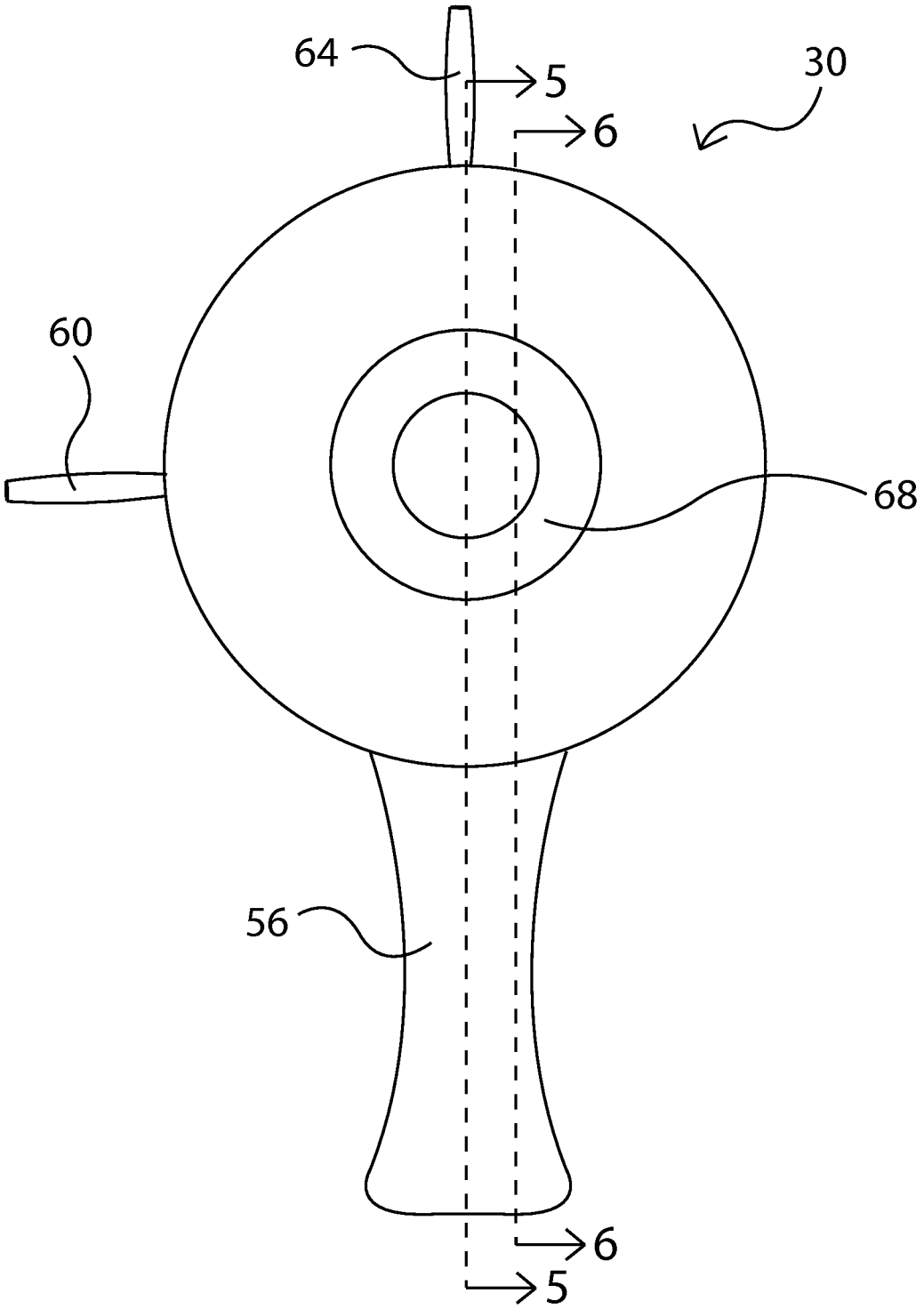
FIG. 4 is a front view of the device shown in FIG. 2.

FIG. 1 shows one embodiment of system 20 for suppressing a fire 22. System 20 comprises a pressurized source of water 24 housed within fire truck 26. Pressurized source of water 24 contains foam generating solutes. Foam solutes may be one or more of the surfactants found in materials such as ANSUL® SILV-EX® Plus, CHEMGUARD® Class A Foam, KIDDE® Class A Foam, Buckeye Foam Concentrate Class A or another chemical solute that helps create foam. Hose 28 delivers the source of pressurized water 24 with foam solutes to device 30 for generating compressed air foam 32. User 33 holds device 30 and directs compressed air foam 32 onto fire 22. Although system 20 shown includes a fire truck 26 and hose 28 along with device 30, other systems could be used without deviating from the scope the present invention. Such other systems maybe, but are not limited to a fire hydrant as source of water, a hose, an educator for adding solutes to the water and device 30 or a piped water system in a building with premixed solutes held in a tank water source and having a device 30 attached to a hose line connected to the piped water system.

Details of device 30 are shown in FIGS. 2-8. Device 30 comprises a water chamber 34 having a water source inlet 36 and a water source outlet 38. A water impeller 40 is at least partially contained within water chamber 34. Water impeller 40 is driven by movement of the source of pressurized water 24. Arrows 24*a* indicate direction of water flow. Device 30 further comprises an air chamber 42 adjacent to water chamber 34. Partition 44 exists between water chamber 34 and air chamber 42. Air chamber 42 has an air source inlet 46 and an air source outlet 48. Arrows 51*a* indicate direction of airflow. An air impeller 50 is at least partially contained within air chamber 42. Water impeller 40 drives air impeller 50. In doing so, air impeller 50 compresses air 51 that enters through air source inlet 46 to create compressed air 52. Compressed air 52 exits through air source outlet 48 to aerate source of water 24 to create compressed air foam 32 prior to the water exiting said water outlet 38. Device 30 includes water source connector 54 to connect source of water 24 to the device. Device 30 may include device handle 56 to aid user 33 in holding the device. Additionally, device 30 may include a water flow adjustor 58 having a water flow adjustor handle 60 and an air flow adjustor 62 having an air flow adjustor handle 64.

Figure 5:
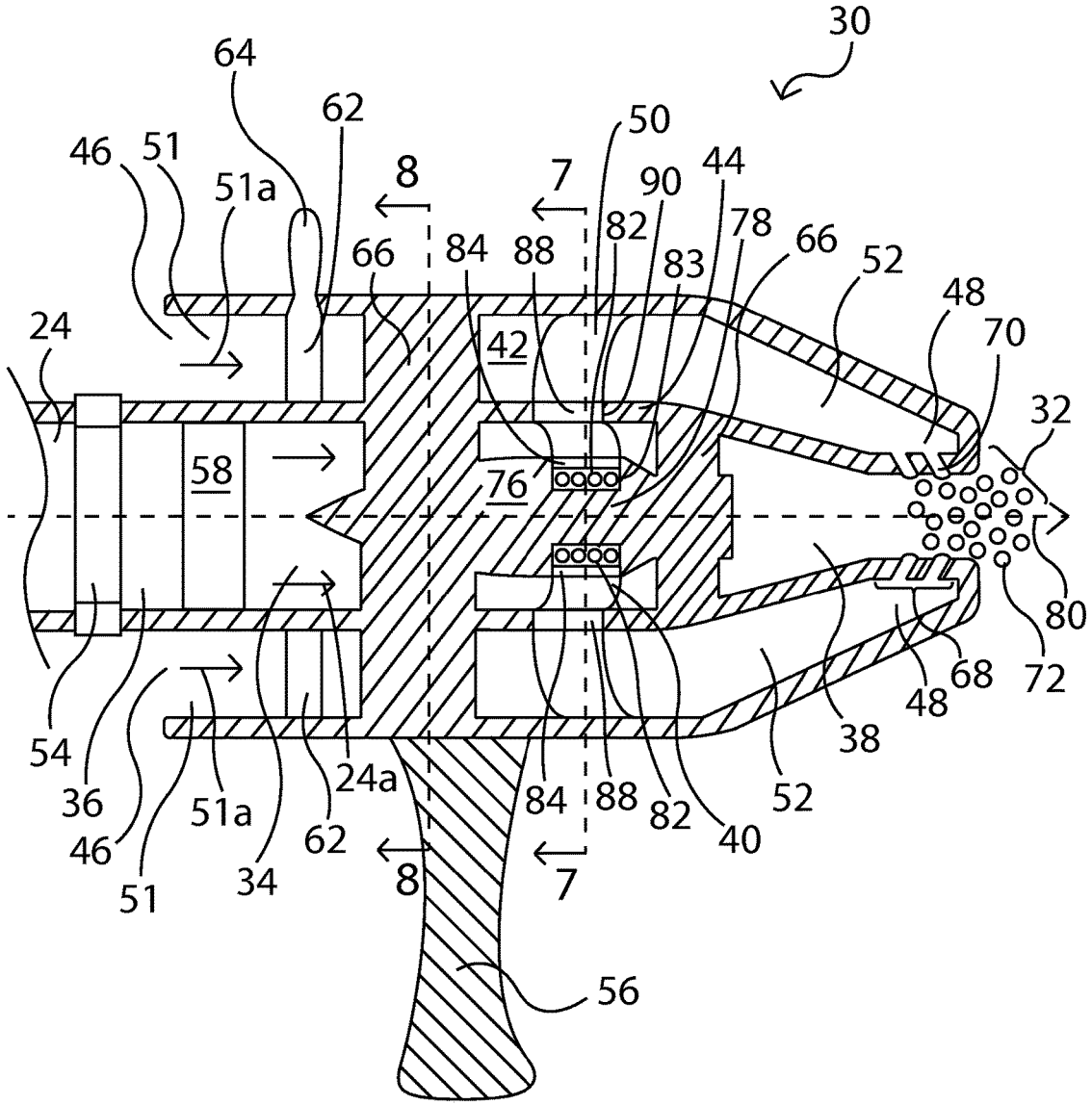
FIG. 5 is a side, sectional view along line 5-5 of the device shown in FIG. 4.
Figure 6:
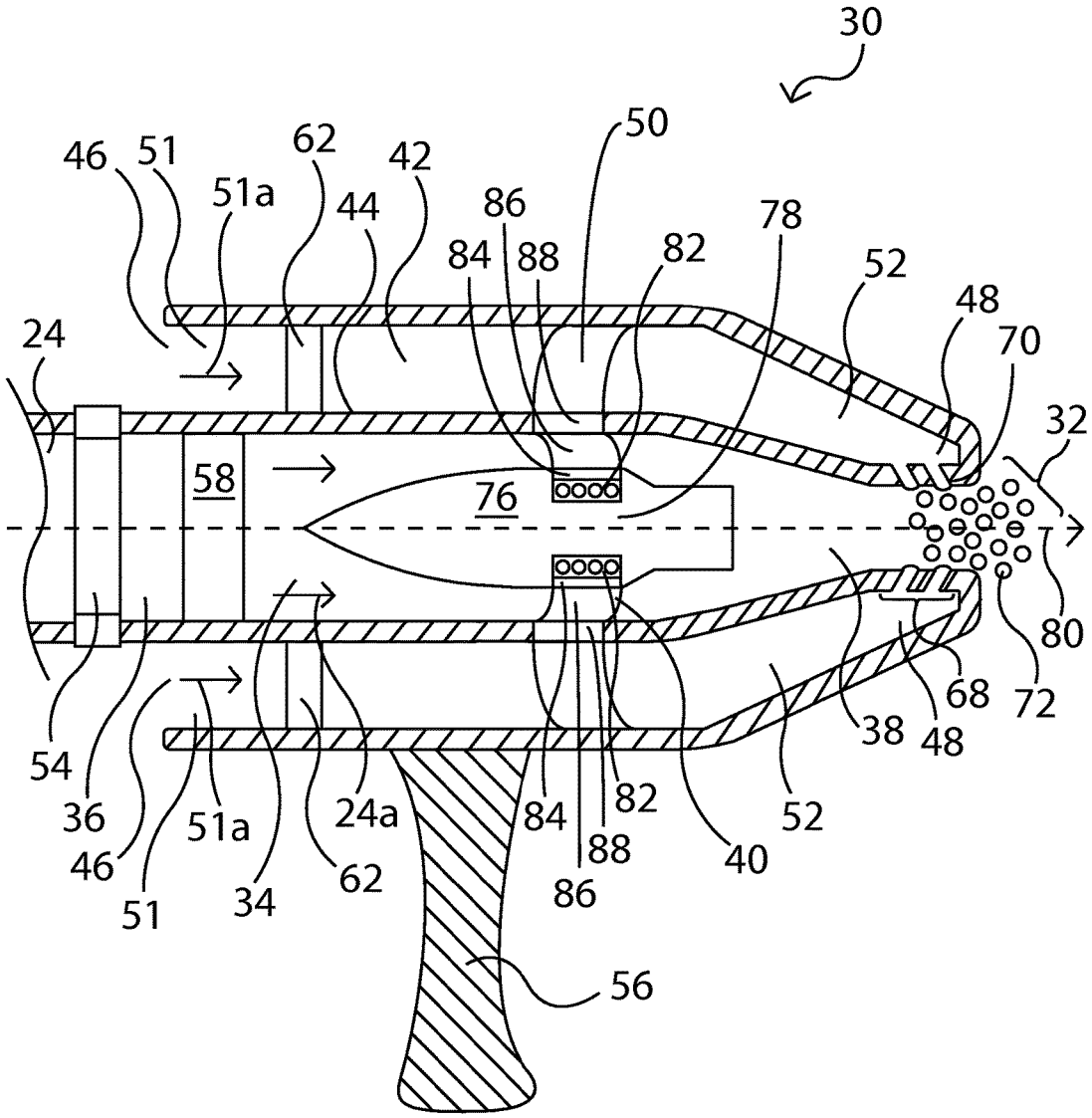
FIG. 6 is a side, sectional view along line 6-6 of the device shown in FIG. 4.
Figure 8:
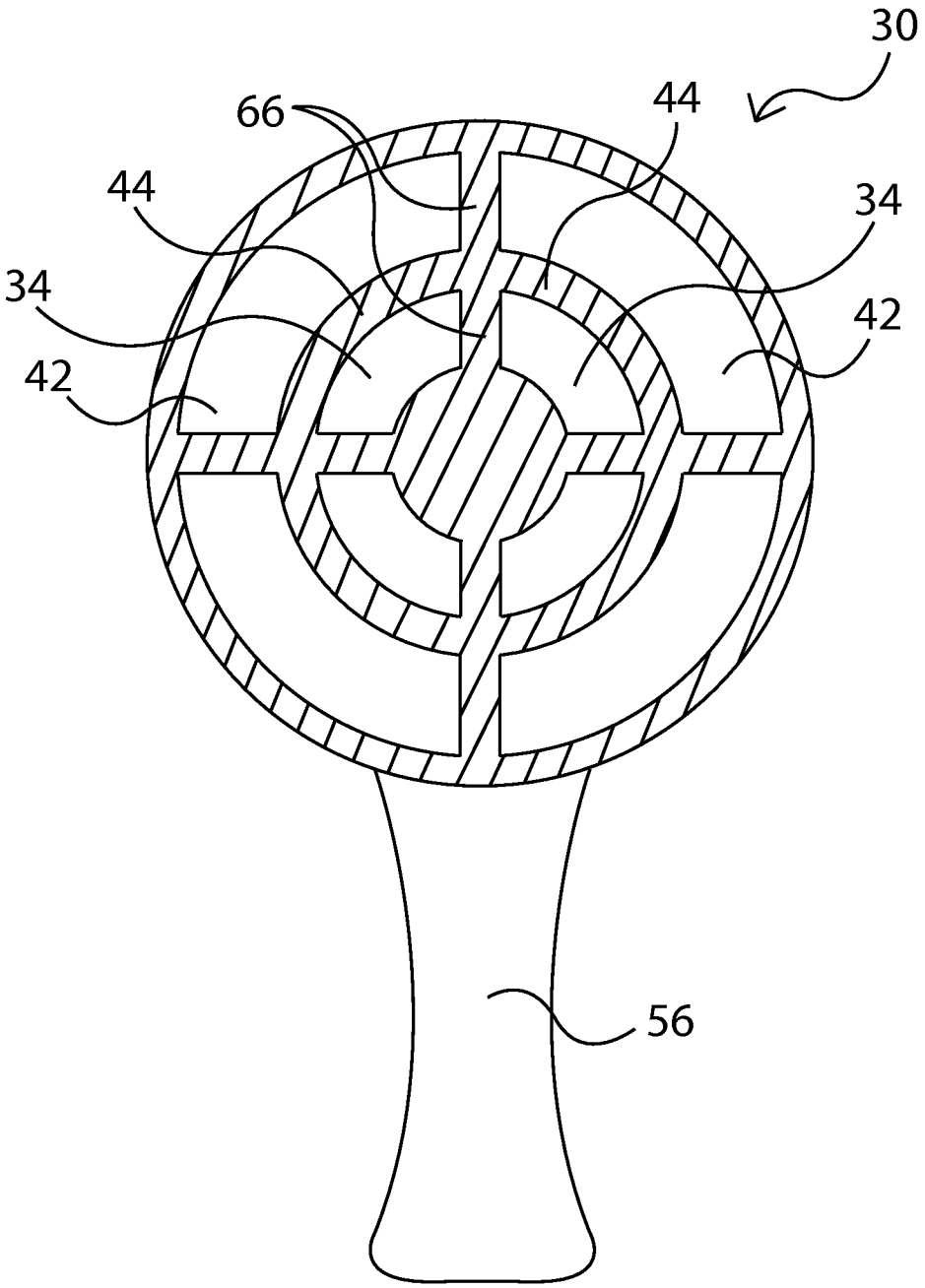
FIG. 8 is front, sectional view along line 8-8 of the device shown in FIG. 5.

Details of water chamber 34, air chamber 42 and their relation to each other are shown in FIGS. 5, 6 and 8. In a preferred embodiment, water chamber 34 is concentric to air chamber 42, however in other embodiments the chambers could be side-by-side. Water chamber 34 may narrow from said water source inlet 36 to said water source outlet 38. Strengthening elements 66 may be placed at various locations within the walls of both water chamber 34 and air chamber 42 to add strength to device 30 and keep the chambers in the correct spaced apart relationship. The movement of air impeller 50 draws air 51 from air source inlet 46 and moves the air through air chamber 42 towards air source outlet 48. Air chamber 42 narrows from air source inlet 46 to air source outlet 48. Air source inlet 46 has an air source inlet area. Air source outlet 48 has an air source outlet area. Air source outlet area is less than said air source inlet area. This narrowing reduces the area the air 51 has to travel through and thereby causes the air to compress and form compressed air 52 that has a higher pressure than the air that was taken into device 30. Compressed air 52 is then introduced into source of water 24 through an opening in partition 44. The opening is generally fitted with a nozzle 68 that contains a plurality of small openings 70. Nozzle 68 also contributes to reducing the area through which air can flow thereby further contributing to the increase in pressure of compressed air 52. Compressed air 52 expands as it exits each small opening 70 to form a bubble of air 72. Foam solutes coat the surface of bubble 72 reducing the surface tension and stabilize the bubble. The plurality of small openings 70 allow for the creation of numerous bubbles 72 that combine to make up foam 32.

Figure 7:
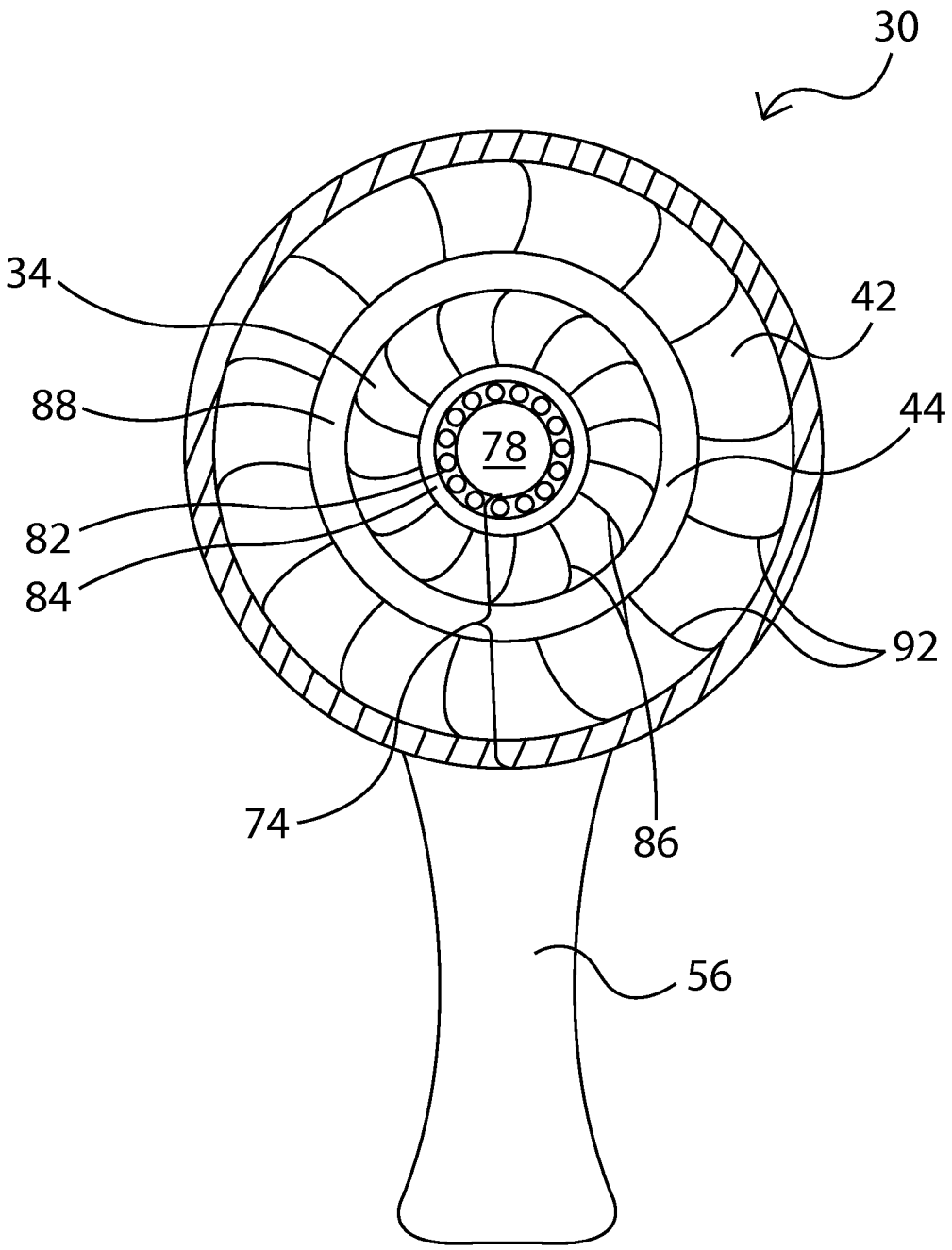
FIG. 7 is front, sectional view along line 7-7 of the device shown in FIG. 5.

Details of the combined impeller system 74 that includes water impeller 40 and air impeller 50 are shown in FIGS. 5, 6 and 7. For an embodiment where water chamber 34 is internal and concentric with air chamber 42, a central shaft 76 is supported interior water chamber 34 by strengthening elements 66. The end of central shaft 76 where water enters device 30 may be tapered to improve hydrodynamic movement of water around the central shaft. A narrowed section, inner race 78 is provided along central shaft 76. Inner race 78 has a circular cross-sectional area that is centered along central axis 80. Roller elements 82 are positioned around inner race 78. Roller elements 82 may be ball bearings, cylindrical bars or other similar rolling element. Outer race 84 surrounds roller elements 82. Outer race 84 freely rotates around inner race 78 on roller elements 82. A water tight seal 83 may be provided to protect the rotation mechanism. A plurality of water blades 86 are positioned around the circumference of outer race 84 and extend into water chamber 34. Water blades 86 are oriented so that pressurized water flowing through water chamber 34 exerts a radial force on the water blades causing outer race 84 and the water blades to turn around inner race 78. Water pressure decreases as it passes through water impeller 40 giving energy up to the water impeller. Water blades 86 are further connected on their end furthest from central axis 80 by an air blade connecting element 88 that moves at least partially within partition 44. An air-water seal 90 is provided between partition 44 and air blade connecting element 88. A plurality of air blades 92 are positioned around the circumference of air blade connecting element 88 and extend into air chamber 42. Air blades 92 rotate around central axis 80 as air blade connecting element 88 is driven by water blades 86. Source of water 24 flows central to air blades 92. Because air blades 92 are further from central axis 80 than water blades 86, air blades 92 move faster than the water blades. Air blades 92 have a tight fit with the walls of air chamber 42 in order for the air pressure to build up downstream from air impeller 50 and limit back flow of air. A velocity increasing mechanism may be added between water impeller 40 and the air impeller 50 to increase the speed of air blades 92 relative to water blades 86.

Water flow adjustor 58 inline with water chamber 34 controls the amount of pressurized water that enters the water chamber of device 30. Water flow adjustor 58 may be a ball valve, slider valve or equivalent water flow regulating device. Water flow adjustor 58 therefore helps control the speed at which water impeller 40 turns. This helps define the speed at which air impeller 50 turns. Water flow adjustor 58 also helps determine how much water (ratio of water to air) will be mixed with compressed air 52. Air flow adjustor 62 inline with air chamber 42 controls the amount of air 51 that enters the air chamber. Air flow adjustor 62 may be two sliding plates with openings. When the openings of one plate are aligned with openings on the other plate the air flow is at a maximum. The air flow is decreased as the plates are moved relative to each other to overlap the openings and reduce the area for air to flow through. The shape, number and spacing of air blades 92 in conjunction with air flow adjustor 62 helps control the amount of compressed air 52 that is created and the pressure of the compressed air.

General operation of device 30 is to connect the device to a pressurized source of water 24 that has foam producing solutes in the water. Device 30 is connected for example to a fire hose 28 by water source connector 54. The amount of initial water pressure and water flow adjustor 58 controls how much water enters device 30 and therefore how fast water impeller 40 rotates. As water impeller 40 rotates, the water impeller drives air impeller 50 such that the air impeller rotates with the water impeller. Air impeller 50 draws air in from air source inlet 46. The velocity of air 51 is increased as it travels through air impeller 50. As the high velocity air has its area of flow reduced by the constricting shape of air chamber 42 and further by restriction of the exit area of nozzle 48, the pressure of the air is increased forming compressed air 52. Compressed air 52 escapes through partition 44 and into source water 24 containing foam solutes. The source water at this point has a reduced pressure after passing through water impeller 40. The water, however, is still moving and provides a Venturi effect that also draws the pressurized air into the water. The combination of the compressed air 52 expanding and the compressed air being drawn by the negative pressure, associated with the Venturi effect, causes tiny bubbles to form in the water that collectively create compressed air foam 32. The compressed air foam exits device 30 with a velocity to be projected and coat a fire to be extinguished. The type of foam 32 that can be generated, for example dryer foam or wetter foam, can be adjusted by using water flow adjustor 58 and air flow adjustor 62. The volume of foam 32 and how far the foam can be sprayed is also adjustable by controlling water flow adjustor 58 and air flow adjustor 62.

There are several options for injecting foam solutes into source of pressurized water. One embodiment is to add solutes in a measured proportion, in bulk, to a tank of water on the fire apparatus. Another embodiment is to have a Venturi system that draws solutes from a source of solutes into the water as the water moves past an opening between the source of solutes and moving water. A detailed description of the apparatus and method for doing this is described in "Injector" from Wikipedia, which is herein incorporated by reference. Still another embodiment is to have solutes pumped into the water source. Other embodiments may integrate sensors that determine water flow and pressure, air flow and pressure, or other sensors that adjusts the amount of solute to be added; all sensors being used to optimize the foam consistency and output. A control unit may be integrated to monitor all sensors and optimize the foam consistency and output.

One of advantages of device 30 is that the device can be easily swapped between different sources of water making the device more versatile. With the current system of retrofitting a fire truck with a compressed air system, if the fire truck is down for some reason so is the compressed air foam system. However, with the present device 30, if the fire truck is down, the device could be taken along with a different truck and then attached to a fire hydrant system to create compressed air foam and thereby still be used to create compressed air foam. Another advantage of device 30 is that it uses no electrical power at the nozzle, only mechanical motion and fluid pressure, to create the foam; this minimizes the chances for electrical shock to a user in an environment where water is everywhere.

The structure of device 30 can also be used for injecting other combinations of fluids from a first fluid into a second fluid. For example, one embodiment could use device 30 for mixing liquid fertilizer into water, where the fluid of air is replaced with a source of liquid fertilizer.

While several embodiments of the invention, together with modifications thereof, have been described in detail herein and illustrated in the accompanying drawings, it will be evident that various further modifications are possible without departing from the scope of the invention. Nothing in the above specification is intended to limit the invention more narrowly than the appended claims. The examples given are intended only to be illustrative rather than exclusive.

What is claimed is:

1. A device for generating compressed air foam from a pressurized source of water containing a foam solute, comprising:

a) a water chamber having a water source inlet and a water source outlet;

b) a water impeller at least partially within said water chamber, said water impeller driven by movement of the source of water;

c) an air chamber adjacent to said water chamber with a partition there between, said air chamber having an air source inlet and an air source outlet;

d) an air impeller at least partially within said air chamber; and e) wherein said water impeller drives said air impeller to compress a source of air to form compressed air, wherein the compressed air exits through an opening in said partition to aerate the source of water and create the compressed air foam prior to the water exiting said water source outlet.

2. A device as recited in claim 1, wherein said air chamber narrows from said air source inlet to said air source outlet.

3. A device as recited in claim 1, wherein said water chamber is concentric with said air chamber.

4. A device as recited in claim 1, wherein said air impeller has a plurality of air blades.

5. A device as recited in claim 4, wherein said air chamber has walls, wherein said air blades are within said walls to limit back flow of air.

6. A device as recited in claim 1, wherein said air impeller rotates with said water impeller.

7. A device as recited in claim 4, wherein said water impeller has a plurality of water blades, wherein said air blades move faster than said water blades.

8. A device as recited in claim 7, further comprising a velocity increasing mechanism working between said water impeller and said air impeller to increase the speed of said air blades relative to said water blades.

9. A device as recited in claim 1, wherein said water impeller has a plurality of water blades.

10. A device as recited in claim 1, wherein said water impeller includes an inner race, roller elements and an outer race; wherein a plurality of water blades is attached to said outer race.

11. A device as recited in claim 10, further comprising an air blade connecting element, wherein said air blade connecting element connects a plurality of air blades to said plurality of water blades.

12. A device as recited in claim 11, wherein said air blade connecting element moves within said partition, wherein said connecting element has an air-water seal to keep the source of pressurized water and the source of air from mixing across said partition.

13. A device as recited in claim 1, further comprising a water flow adjustor inline with said water chamber for varying the amount of water flowing through said water chamber.

14. A device as recited in claim 1, further comprising an air flow adjustor inline with said air chamber, said air flow adjustor adjusting the amount source air to be mixed with said the source of water to adjust the compressed air foam from wet to dry foam.

15. A device for generating compressed air foam from a pressurized source of water containing a foam solute, comprising:

a) a water source inlet for receiving the source of water containing the foam solute;

b) an impeller system driven by the source of water to generate compressed air; and c) wherein said water source inlet for receiving the water with the foam solute is located prior to entering said impeller system, wherein the compressed air is forced into the source of water to aerate the source of water and create compressed air foam.

16. A device as recited in claim 1, wherein said opening in said partition is a plurality of openings.

17. A device for generating compressed air foam from a pressurized source of water containing a foam solute, comprising:

a) a water chamber having a water source inlet and a water source outlet;

b) a water impeller at least partially within said water chamber, said water impeller driven by movement of the source of water;

c) an air chamber adjacent to said water chamber with a partition there between, said air chamber having an air source inlet and an air source outlet;

d) an air impeller at least partially within said air chamber; and e) wherein said water impeller drives said air impeller to compress a source of air to form compressed air, wherein the negative pressure associated with a Venturi effect combines with the compressed air to increase drawing of the air into the water, wherein the compressed air exits through said air source outlet to aerate the source of water and create compressed air foam.

18. A device for generating compressed air foam from a pressurized source of water containing a foam solute, comprising:

a) a water chamber having a water source inlet and a water source outlet;

b) a water impeller at least partially within said water chamber, said water impeller driven by movement of the source of water;

c) an air chamber adjacent to said water chamber with a partition there between, said air chamber having an air source inlet with an air source inlet area and an air source outlet with an air source outlet area, said air source outlet area less than said air source inlet area;

d) an air impeller at least partially within said air chamber; and e) wherein said water impeller drives said air impeller to compress a source of air to form compressed air, wherein the compressed air exits through said air source outlet to aerate the source of water and create compressed air foam.

19. A as recited in claim 18, wherein said air chamber narrows prior to injecting the air into the source of water.

20. A device for generating compressed air foam from a pressurized source of water containing a foam solute, comprising:

a) a water chamber having a water source inlet and a water source outlet;

b) a water impeller at least partially within said water chamber, said water impeller driven by movement of the source of water;

c) an air chamber adjacent to said water chamber with a partition there between, said air chamber having an air source inlet and an air source outlet;

d) an air impeller at least partially within said air chamber, said air impeller having a plurality of air blades: and e) wherein said water impeller drives said air impeller to compress a source of air to form compressed air, wherein said water chamber is internal said air chamber and the source of water flows central to said air blades, wherein the compressed air exits through said air source outlet to aerate the source of water and create compressed air foam.

21. A device as recited in claim 1, wherein said water chamber narrows prior to said water source outlet.

* * * * *